US012528570B2

(12) United States Patent
Takewaka

(10) Patent No.: US 12,528,570 B2
(45) Date of Patent: Jan. 20, 2026

(54) WATER JET PROPULSION BOAT AND DIRECTION CHANGING DEVICE FOR WATER JET PROPULSION BOAT

(71) Applicant: YAMAHA HATSUDOKI KABUSHIKI KAISHA, Iwata (JP)

(72) Inventor: Masato Takewaka, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 418 days.

(21) Appl. No.: 18/220,901

(22) Filed: Jul. 12, 2023

(65) Prior Publication Data

US 2024/0051649 A1 Feb. 15, 2024

(30) Foreign Application Priority Data

Aug. 12, 2022 (JP) ..... 2022-128965

(51) Int. Cl.
*B63H 11/113* (2006.01)

(52) U.S. Cl.
CPC ..... *B63H 11/113* (2013.01)

(58) Field of Classification Search
CPC ..... B63B 34/10; B63H 11/113
See application file for complete search history.

(56) References Cited

U.S. PATENT DOCUMENTS 7,052,338 B2 * 5/2006 Morvillo ..... B63H 11/117 440/41
7,166,003 B2 * 1/2007 Motose ..... F02D 11/105 440/87
7,195,527 B2 * 3/2007 Tani ..... B63H 21/22 440/87
9,555,867 B2 * 1/2017 Okamoto ..... B63H 11/04
10,919,608 B1 * 2/2021 Kunanec ..... B63H 11/08
2005/0118899 A1 * 6/2005 Tsumiyama ..... B63H 11/113 440/41
2010/0041286 A1 * 2/2010 Bourret ..... B63H 11/107 440/41
2020/0047859 A1 * 2/2020 Kinomoto ..... B63B 34/10
(Continued)

FOREIGN PATENT DOCUMENTS

JP 06219386 A * 8/1994
JP 08-40362 A 2/1996
(Continued)

*Primary Examiner* — S. Joseph Morano
*Assistant Examiner* — Jovon E Hayes
(74) *Attorney, Agent, or Firm* — Keating & Bennett, LLP

(57) ABSTRACT

A water jet propulsion boat includes a hull, a jet generator, a direction changer, a steering device, and a shift mechanism. The direction changer is pivotable with respect to the hull about a first pivot axis extending along a first direction and about a second pivot axis extending along a second direction perpendicular to the first direction. The shift mechanism includes a first actuator to shift a first portion of the direction changer in a third direction perpendicular to both the first direction and the second direction, and a second actuator to shift a second portion of the direction changer in the third direction. The first pivot axis is between the first and second portions when viewed in the first direction, and both the first and second portions are on one side of the first direction with respect to the second pivot axis when viewed in the second direction.

16 Claims, 8 Drawing Sheets

(56) References Cited

U.S. PATENT DOCUMENTS

| | | | | |
|---|---|---|---|---|
| 2022/0177087 | A1* | 6/2022 | Amma | B63B 34/10 |
| 2024/0083566 | A1* | 3/2024 | Suzuki | B63B 34/10 |

FOREIGN PATENT DOCUMENTS

| | | | | | |
|---|---|---|---|---|---|
| JP | 2552611 | B2 | * | 11/1996 | |
| JP | 2000272585 | A | * | 10/2000 | B63H 21/22 |
| JP | 2001328593 | A | * | 11/2001 | B63H 11/107 |

* cited by examiner

WATER JET PROPULSION BOAT AND DIRECTION CHANGING DEVICE FOR WATER JET PROPULSION BOAT

CROSS REFERENCE TO RELATED APPLICATIONS

This application claims the benefit of priority to Japanese Patent Application No. 2022-128965 filed on Aug. 12, 2022. The entire contents of this application are hereby incorporated herein by reference.

BACKGROUND OF THE INVENTION

1. Field of the Invention

The techniques disclosed herein relate to water jet propulsion boats.

2. Description of the Related Art

Conventionally, water jet propulsion boats have been known to include a jet generator, a direction changing member, and a shift mechanism. The jet generator is driven by a driving source such as an engine and generates a jet of water by ejecting water sucked in from the outside of the hull from a jetting port to rearwardly of the hull. The direction changing member is, e.g., a deflector, which is provided so that the jet stream direction of the jet of water generated by the jet generator is changeable. The shift mechanism shifts the direction changing member according to the operation by the steering device disposed on the hull. For example, in one water jet propulsion boat, the shift mechanism has a pair of hydraulic cylinders and is configured to shift the direction changing member in the left-right direction by the pair of hydraulic cylinders (see, e.g., JP H06-219386A and JP 2552611B). In another water jet propulsion boat, the shift mechanism has four hydraulic cylinders, and these four hydraulic cylinders are configured to shift the direction changing member in the upper-lower and left-right directions (see, e.g., JP H08-040362A).

In the conventional water jet propulsion boats described above, there is room for improvement, e.g., there is a restriction on the direction in which the direction changing member is able to be shifted with respect to the number of actuators such as hydraulic cylinders.

SUMMARY OF THE INVENTION

Preferred embodiments of the present invention solve the above problems.

A water jet propulsion boat according to a preferred embodiment of the present invention includes a hull, a jet generator on the hull to eject a jet of water, a direction changer to change a jet stream direction of the jet of water generated by the jet generator, a steering device on the hull, and a shift mechanism to shift the direction changer according to an operation by the steering device, wherein the direction changer is pivotable with respect to the hull about a first pivot axis extending along a first direction and about a second pivot axis extending along a second direction perpendicular to the first direction, the shift mechanism includes a first actuator to shift a first portion of the direction changer in a third direction perpendicular to both the first direction and the second direction, and a second actuator to shift a second portion of the direction changer in the third direction, the first pivot axis is located between the first portion and the second portion when viewed in the first direction, and both the first portion and second portion are positioned on one side of the second pivot axis with respect to the first direction when viewed in the second direction.

A direction changing device for a water jet propulsion boat according to another preferred embodiment of the present invention changes a jet stream direction of a jet of water generated by a jet generator on a hull, the direction changing device including a direction changer, a shift mechanism to shift the direction changer according to an operation by a steering device on the hull, wherein the direction changer is pivotable with respect to the hull about a first pivot axis extending along a first direction and about a second pivot axis extending along a second direction perpendicular to the first direction, the shift mechanism includes a first actuator to shift a first portion of the direction changer in a third direction perpendicular to both the first direction and the second direction, and a second actuator to shift a second portion of the direction changer in the third direction, the first pivot axis is located between the first portion and the second portion when viewed in the first direction, and both the first portion and second portion are positioned on one side of the second pivot axis with respect to the first direction when viewed in the second direction.

The techniques disclosed herein may be implemented in various aspects, such as a water jet propulsion boat, a direction changing device for a water jet propulsion boat, a method for shifting a direction changer, and a non-transitory computer readable medium including a computer program for implementing such a method or the function of such a device.

According to the water jet propulsion boats disclosed herein, the jet stream direction is able to be shifted in two directions perpendicular to each other by the first and second actuators.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
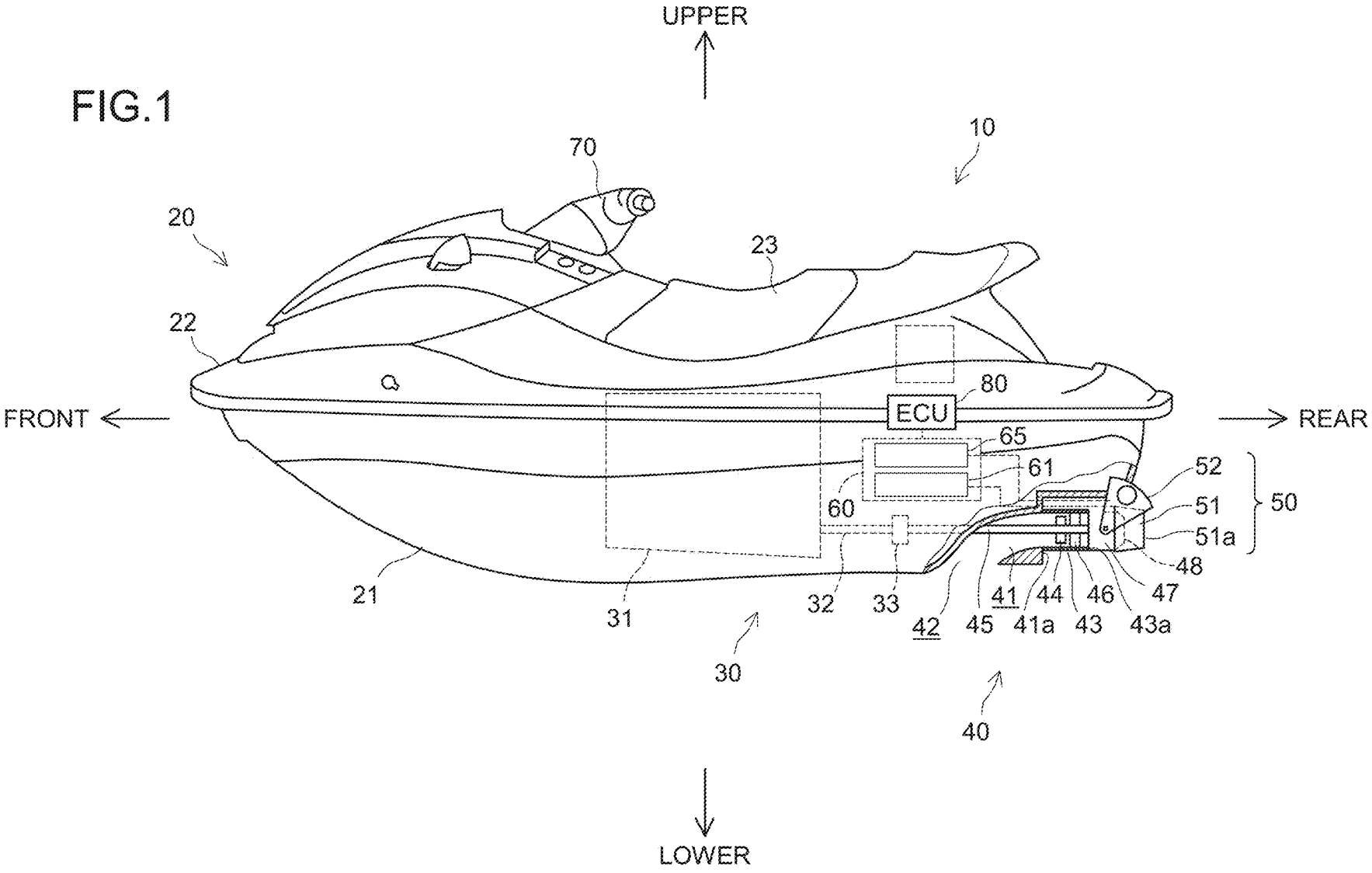
FIG. 1 is a side view schematically illustrating a configuration of a water jet propulsion boat according to a preferred embodiment of the present invention.

FIG. 1 is a side view schematically illustrating a configuration of a water jet propulsion boat 10 according to a preferred embodiment of the present invention. FIG. 1 and other figures described below show arrows representing each direction with respect to the position of the water jet propulsion boat 10. More specifically, each figure shows arrows representing front (FRONT), rear (REAR), left (LEFT), right (RIGHT), upper (UPPER), and lower (LOWER), respectively. The front-rear direction, the left-right direction, and the upper-lower (vertical) direction are each perpendicular to each other. The upper-lower direction is an example of a first direction, the left-right direction is an example of a second direction, and the front-rear direction is an example of a third direction.

The water jet propulsion boat 10 includes a hull 20, a driving device 30, a jet generator 40, a jet adjustment mechanism 50, a shift mechanism 60, a steering device 70, and a control device (ECU) 80. The jet adjustment mechanism 50 and the shift mechanism 60 are examples of a direction changing device for a water jet propulsion boat.

The hull 20 includes a hull body 21, a deck 22, and a seat 23. The hull body 21 defines the bottom of the hull 20 and the deck 22 defines the top of hull 20. The seat 23 is positioned approximately in the center of the hull 20 in the front-rear direction so that a user (crew), not shown, can sit.

The driving device 30 includes an engine 31, a crankshaft 32, and a coupling 33. Within the hull 20, the driving device 30 is disposed in a space defined between the hull body 21 and the deck 22. The engine 31 is a spark-ignited, multi-cylinder internal combustion engine, for example. The engine 31 is disposed below the seat 23. The crankshaft 32 is a rotating shaft that outputs the driving torque generated by the engine 31. The crankshaft 32 extends rearwardly from the driving device 30. The coupling 33 connects the crankshaft 32 with an impeller shaft 45, which will be described below, so that the driving torque of the crankshaft 32 is able to be transmitted to the impeller shaft 45.

The jet generator (water jet propulsion mechanism) 40 is provided in the rear portion of the hull body 21 of the hull 20. The jet generator 40 includes a channel 41, an impeller housing 43, an impeller 44, an impeller shaft 45, a stator blade 46, and a nozzle 47.

The channel 41 is provided in the rear portion of the hull body 21 of the hull 20 and in the center portion in the left-right direction. One end of the channel 41 opens downward from the hull body 21 as a water suction port 42 to suck in water. The channel 41 extends rearwardly from the water suction port 42, and the other end 41*a* of the channel 41 opens rearwardly from the hull body 21.

The impeller housing 43 has a substantially cylindrical body extending in the front-rear direction and projects from the other end 41*a* of the channel 41 rearwardly from the hull body 21. The impeller 44 is housed in the impeller housing 43 and connected to the rear end of the impeller shaft 45. This allows the impeller 44 to rotate integrally with the impeller shaft 45 around the central axis of the impeller shaft 45. The stator blade 46 is disposed behind the impeller 44 in the impeller housing 43. The nozzle 47 is a cylindrical member and is fixed to the rear end 43*a* of the impeller housing 43. The rear end of the nozzle 47 opens as a jetting port 48 to eject water therefrom.

With such a configuration, when the driving torque generated by the engine 31 is transmitted to the impeller shaft 45 to rotate the impeller 44, water is sucked into the channel 41 from the outside of the hull 20 (below the hull body 21) through the water suction port 42. The water sucked into the channel 41 is supplied by the impeller 44 to the stator blade 46. The water supplied by the impeller 44 is rectified by passing through the stator blade 46. The rectified water passes through the nozzle 47 and is ejected from the jetting port 48 to the rearward of the hull 20. In this way, the jet generator 40 can generate a jet of water rearwardly from the hull 20. According to this configuration, the higher the rotation speed of the engine 31, the higher the flow rate of the jet ejected from the jet generator 40. Therefore, the amount of jet ejected from the jet generator 40 is adjusted by changing the operating state (rotation speed) of the engine 31.

The jet adjustment mechanism 50 includes a deflector 51 and a reverse bucket 52. The deflector 51 is an example of a direction changing member.

Figure 2:
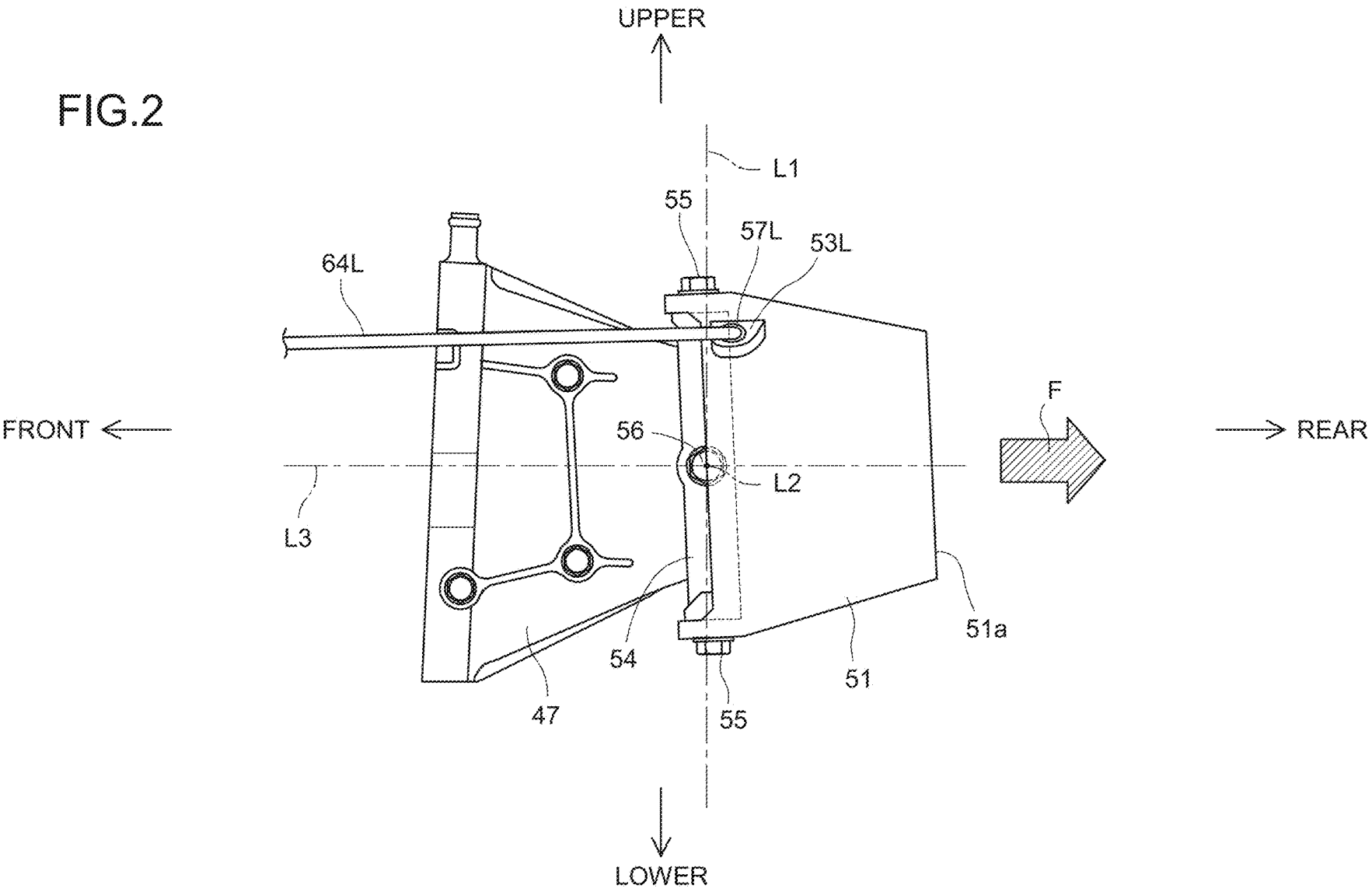
FIG. 2 is an explanatory view illustrating a side configuration of a nozzle and a deflector.
Figure 3:
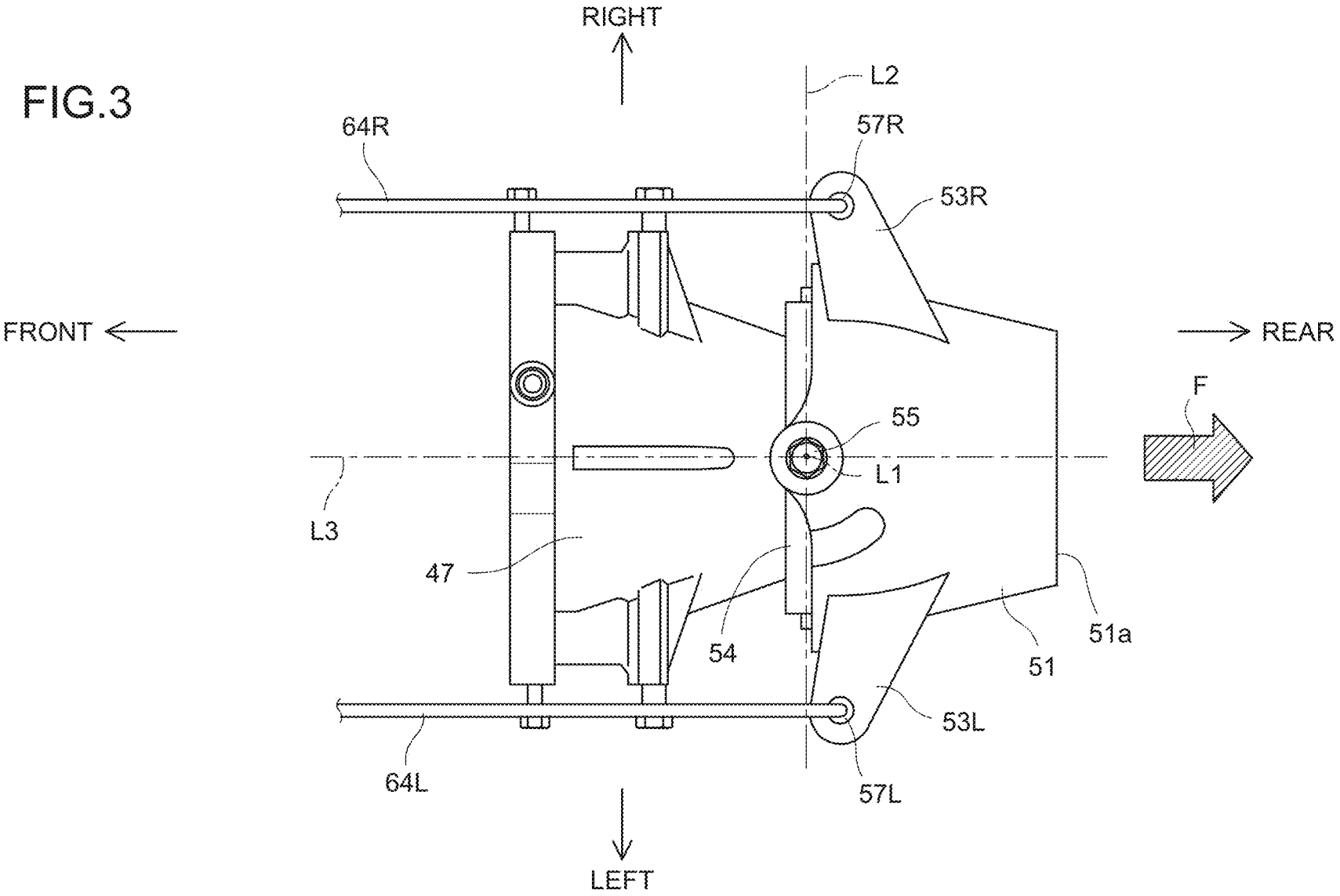
FIG. 3 is an explanatory view illustrating a top configuration of the nozzle and the deflector.
Figure 4:
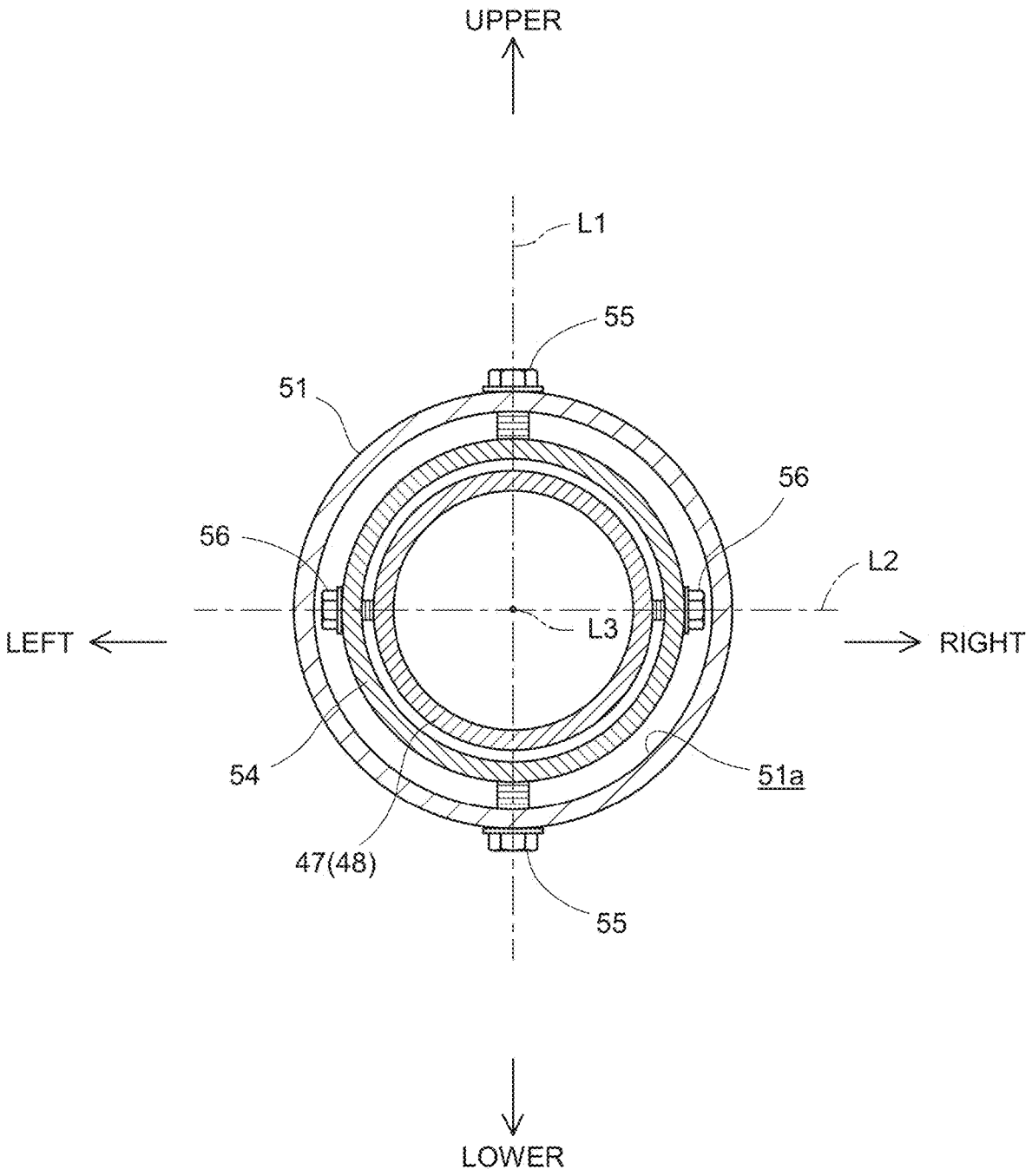
FIG. 4 is a cross-sectional view of the nozzle and the deflector when viewed in the front-rear direction.

FIG. 2 is an explanatory view illustrating a side configuration of the nozzle 47 and the deflector 51, FIG. 3 is an explanatory view illustrating a top configuration of the nozzle 47 and the deflector 51, and FIG. 4 is a cross-sectional view of the nozzle 47 and the deflector 51 when viewed in the front-rear direction. The deflector 51 changes the jet stream direction of the jet of water generated by the jet generator 40.

Specifically, as shown in FIGS. 1 to 3, the deflector 51 is a substantially cylindrical (frusto-conical) member having an inner diameter that becomes smaller toward the rearward direction of the hull 20. The deflector 51 is disposed behind the nozzle 47 and covers the jetting port 48 of the nozzle 47. Therefore, the jet of water ejected from the jetting port 48 of the nozzle 47 passes through the deflector 51 and is ejected from an ejection port 51*a*.

The deflector 51 is pivotable with respect to the hull 20 around a first pivot axis L1 extending along the upper-lower direction (vertical direction) and around a second pivot axis L2 extending along the left-right direction (horizontal direction) (see FIGS. 7A, 7B, 8A, and 8B below).

Specifically, an intermediate member 54 is disposed between the deflector 51 and the nozzle 47 (see FIG. 4). The deflector 51 is supported pivotably with respect to the nozzle 47 via the intermediate member 54. The intermediate member 54 is an annular member and surrounds the entire circumference of the outer peripheral surface of the rear end side of the nozzle 47 and disposed on the inner peripheral side of the front end side of the deflector 51. The deflector 51 is connected to the intermediate member 54 via a pair of first support members 55 so as to be pivotable around the first pivot axis L1. The intermediate member 54 is connected to the nozzle 47 via a pair of second support members 56 so as to be pivotable around the second pivot axis L2. In this way, the ejection direction F from the ejection port 51*a* of the deflector 51 can be changed in the left-right direction around the first pivot axis L1 (see FIGS. 8A and 8B below) and in the upper-lower direction around the second pivot axis L2 (see FIGS. 7A and 7B below).

As shown in FIGS. 2 and 3, the deflector 51 includes a right projection 53R and a left projection 53L. The right projection 53R is provided on the right side of the deflector 51, and the left projection 53L is provided on the left side of the deflector 51. The right projection 53R and the left projection 53L project from the outer peripheral surface of the front end side of the deflector 51, respectively. A right connecting portion 57R is provided at the tip of the right projection 53R, and a left connecting portion 57L is provided at the tip of the left projection 53L. The right connecting portion 57R and the left connecting portion 57L are examples of first and second portions.

As shown in FIG. 3, when viewed in the upper-lower direction, the first pivot axis L1 is positioned between the right connecting portion 57R and the left connecting portion 57L. In FIG. 3, when viewed in the upper-lower direction, the positional relationship between the right connecting portion 57R and the left connecting portion 57L is symmetrical with respect to the first pivot axis L1 (see FIG. 3). In addition, the right connecting portion 57R and the left connecting portion 57L are disposed at positions symmetrical with respect to the central axis (in FIG. 3, it coincides with the central axis L3 of the nozzle 47) of the deflector 51. As shown in FIG. 2, both the right connecting portion 57R and the left connecting portion 57L are located on an upper side (above) with respect to the second pivot axis L2 when viewed in the left-right direction. In FIG. 2, both the right connecting portion 57R and the left connecting portion 57L are disposed on the upper side of the deflector 51.

The right connecting portion 57R and the left connecting portion 57L are aligned in a direction that is parallel to the second pivot axis L2 (see FIG. 3). In this specification, the phrase "A and B are parallel" does not necessarily mean that A and B are completely parallel, but includes that the angle difference between A and B is within 5 degrees. Similarly, the phrase "A and B are perpendicular" is not limited to an angle difference between A and B of 90 degrees, but includes an angle difference between A and B within 90 degrees plus or minus 5 degrees.

The reverse bucket 52 is disposed on the rear side of the deflector 51 and is shiftable among the forward position, the neutral position, and the rearward position with respect to the jet generator 40. The forward position does not cover the ejection port 51*a* of the deflector 51 (see FIG. 1), the neutral position partially covers the ejection port 51*a* of the deflector 51, and the rearward position completely covers the ejection port 51*a* of the deflector 51.

The shift mechanism 60 includes a deflector moving mechanism 61 and a reverse bucket moving mechanism 65.

The deflector moving mechanism 61 shifts the deflector 51 according to the operation by the steering device 70. The deflector moving mechanism 61 includes a right-side trim actuator 62R and a left-side trim actuator 62L (see FIG. 6 and below).

The right-side trim actuator 62R shifts the right connecting portion 57R of the deflector 51 in the front-rear direction. Specifically, the right-side trim actuator 62R includes a link mechanism (not shown) with a servomotor and a trim arm 64R. The trim arm 64R is extends along the front-rear direction, the front end of the trim arm 64R is connected to the link mechanism, and the rear end of the trim arm 64R is connected to the right connecting portion 57R. The link mechanism shifts the trim arm 64R in the front-rear direction by the driving force of the servomotor. When the trim arm 64R is shifted in the front-rear direction, the right connecting portion 57R of the deflector 51 is shifted in the front-rear direction. The right-side trim actuator 62R is an example of a first actuator.

The left-side trim actuator 62L shifts the left connecting portion 57L of the deflector 51 in the front-rear direction. Specifically, the left-side trim actuator 62L includes a link mechanism (not shown) with a servomotor and a trim arm 64L. The trim arm 64L extends along the front-rear direction, the front end of the trim arm 64L is connected to the link mechanism, and the rear end of the trim arm 64L is connected to the left connecting portion 57L. The link mechanism shifts the trim arm 64L in the front-rear direction by the driving force of the servomotor. When the trim arm 64L is shifted in the front-rear direction, the left connecting portion 57L of the deflector 51 is shifted in the front-rear direction. The left-side trim actuator 62L is an example of a second actuator.

The reverse bucket moving mechanism 65 includes a shift actuator 66. The shift actuator 66 shifts the reverse bucket 52.

The shift mechanism 60 further includes a steer-by-wire (hereinafter referred to as "SBW") 63. The SBW 63 transmits the operation of the steering device 70 to the right-side trim actuator 62R, the left-side trim actuator 62L, and the shift actuator 66 by electrical control. For example, the steering device 70 includes, among other components, sensors 81, 82 to detect various operations to be described below, and the SBW 63 receives output signals from the sensors 81, 82 that detect various operations of the steering device 70 to control the right-side trim actuator 62R, the left-side trim actuator 62L, and the shift actuator 66 according to the operation of the steering device 70 based on the output signals.

Figure 5:
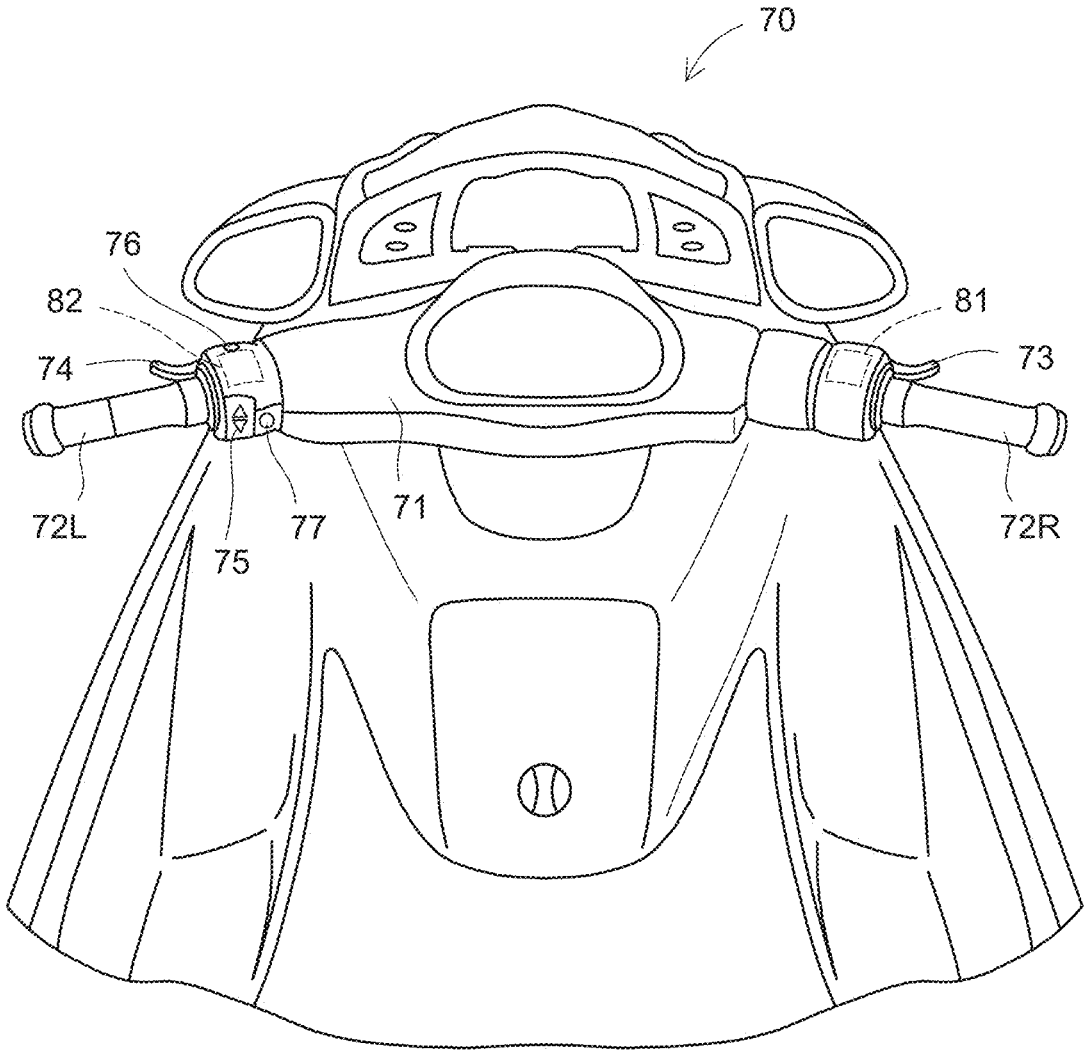
FIG. 5 is an explanatory view illustrating an external configuration of a steering device.

FIG. 5 is an explanatory view illustrating an external configuration of a steering device 70. FIG. 5 shows an external configuration around a steering handle 71 as seen from the user seated on the seat 23. As shown in FIG. 5, the steering device 70 includes a steering handle 71, a right grip portion 72R, a left grip portion 72L, a first operator 73, a second operator 74, a third operator 75, a start switch 76, and a stop switch 77.

The steering handle 71 includes a pair of bar-shaped sections extending in the left-right direction with respect to the hull 20 and is supported pivotably around a pivot axis extending along the upper-lower direction. The right grip portion 72R is provided on the right side of the steering handle 71, and the left grip portion 72L is provided on the left side of the steering handle 71. The user of the water jet propulsion boat 10 is able to turn the steering handle 71 by gripping the right grip portion 72R and the left grip portion 72L. When the steering handle 71 is turned, the deflector 51 is turned in the left-right direction via the shift mechanism 60 (see FIGS. 8A and 8B below).

The first operator 73 includes a lever that is able to be moved by the user within a predetermined first range to change the operation amount (amount of driving operation). The lever of the first operator 73 is pivotably supported near the base end of the right grip portion 72R. The operation amount (i.e., the amount of movement of the lever) of the first operator 73 is detected by a first position sensor 81 disposed at an upper portion of the first operator 73. The first position sensor 81 may be a well-known potentiometer. In a state where a predetermined forward operation is performed on the lever of the first operator 73, the output (rotation speed) of the engine 31 is changed according to the operation amount of the first operator 73. Thus, the first operator 73, the operation amount of which is changeable, is operated mainly when the water jet propulsion boat 10 is moved forward.

The second operator 74 includes a lever that is able to be moved by the user within a predetermined second range to change the operation amount (amount of driving operation). The lever of the second operator 74 is pivotably supported near the base end of the left grip portion 72L. The operation amount (i.e., the amount of movement of the lever) of the second operator 74 is detected by a second position sensor 82 disposed at an upper portion of the second operator 74. The second position sensor 82 may be a well-known potentiometer. In a state where a predetermined reverse operation described below is performed on the lever of the second operator 74, the output (rotation speed) of the engine 31 is changed according to the operation amount of the second operator 74. Thus, the second operator 74, the operation amount of which is changeable, is operated mainly when the water jet propulsion boat 10 is moved rearward.

The third operator 75 is, e.g., a push-button switch and includes an up switch 75*a* and a down switch 75*b* (see FIG. 6 and below). The third operator 75 is disposed, e.g., near the left grip portion 72L and on the inner side of the left grip portion 72L in the left-right direction. Therefore, the user can easily operate the third operator 75 with the left thumb while holding the left grip portion 72L with the left hand. When the third operator 75 is operated, the position of the jet adjustment mechanism 50 (deflector 51, reverse bucket 52) is changed according to the operation.

The start switch 76 is disposed on the front side surface of the steering handle 71 near the third operator 75. The start switch 76 is a switch to start the engine 31, and may be a push-button switch.

The stop switch 77 is disposed on the rear-side surface of the steering handle 71 to the right of the third operator 75. The stop switch 77 is a switch to stop the engine 31, and may be a push-button switch.

Figure 6:
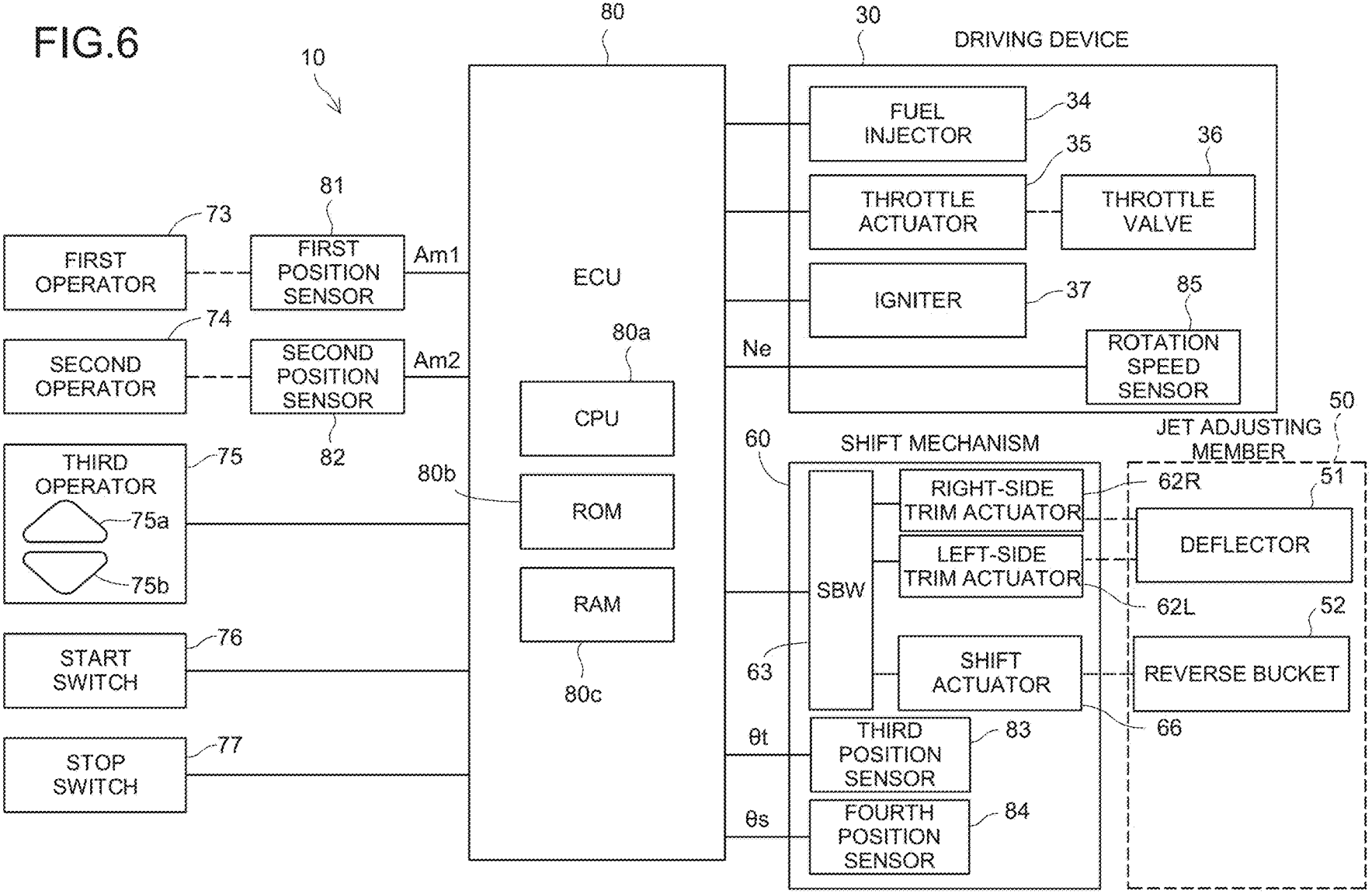
FIG. 6 is a block diagram illustrating a control configuration of the water jet propulsion boat.

FIG. 6 is a block diagram illustrating a control configuration of the water jet propulsion boat 10. As shown in FIG. 6, the driving device 30 includes a fuel injector 34, a throttle actuator 35, a throttle valve 36, and an igniter 37. The fuel injector 34 supplies fuel to a combustion chamber (not shown) of the engine 31. The throttle actuator 35 changes the opening of the throttle valve 36. The throttle valve 36 adjusts the amount of intake air to the engine 31. The throttle valve 36 is shared by a plurality of cylinders of the engine 31. The igniter 37 ignites the fuel (mixture) in the combustion chamber. The fuel injector 34 and the igniter 37 are provided in each cylinder of the engine 31, respectively. The throttle valve 36 may be provided in each cylinder of the engine 31.

The ECU 80 is an abbreviation for electronic control unit and includes CPU 80*a*, ROM 80*b*, RAM 80*c*, backup RAM (or non-volatile memory not shown), and interface I/F (not shown). The CPU 80*a* implements various functions by executing instructions (routines) stored in a memory (ROM 80*b*).

The ECU 80 is electrically connected to the fuel injector 34, the throttle actuator 35, the igniter 37, and the SBW 63. The ECU 80 is electrically connected to the third operator 75, the start switch 76, the stop switch 77, the first position sensor 81, the second position sensor 82, a third position sensor 83, a fourth position sensor 84, and a rotation speed sensor 85. The ECU 80 is configured to receive output signals from these switches and sensors.

The first position sensor 81 is configured to generate an output signal representing the operation amount (first accelerator operation amount) Am1 of the first operator 73. The second position sensor 82 is configured to generate an output signal representing the operation amount (second accelerator operation amount) Am2 of the second operator 74. The third position sensor 83 is configured to generate an output signal representing the rotation angle θt of the trim actuator 62. The fourth position sensor 84 is configured to generate an output signal representing the rotation angle θs of the shift actuator 66. The rotation speed sensor 85 is configured to generate an output signal representing the rotation speed Ne of the crankshaft 32.

The ECU 80 is configured to move the reverse bucket 52 to the forward position when the engine 31 is stopped. In addition, the ECU 80 is configured to move the reverse bucket 52 from the forward position to the neutral position when the engine 31 is started. The sailing mode in which the reverse bucket 52 is moved from the forward position to the neutral position is sometimes referred to as the neutral mode.

If the first operator 73 is operated when the reverse bucket 52 is in the neutral position and the first operation amount Am1 is equal to or greater than a predetermined operation amount, the ECU 80 moves the reverse bucket 52 to the forward position and increases the opening of the throttle valve 36 according to the size of the first operation amount Am1. Such a sailing mode is sometimes referred to as a forward mode.

If the second operator 74 is operated when the reverse bucket 52 is in the neutral position and the second operation amount Am2 is equal to or greater than a predetermined operation amount, the ECU 80 moves the reverse bucket 52 to the reverse position and increases the opening of the throttle valve 36 according to the size of the second operation amount Am2. Such a sailing mode is sometimes referred to as a reverse mode.

Figures 7A, 7B:
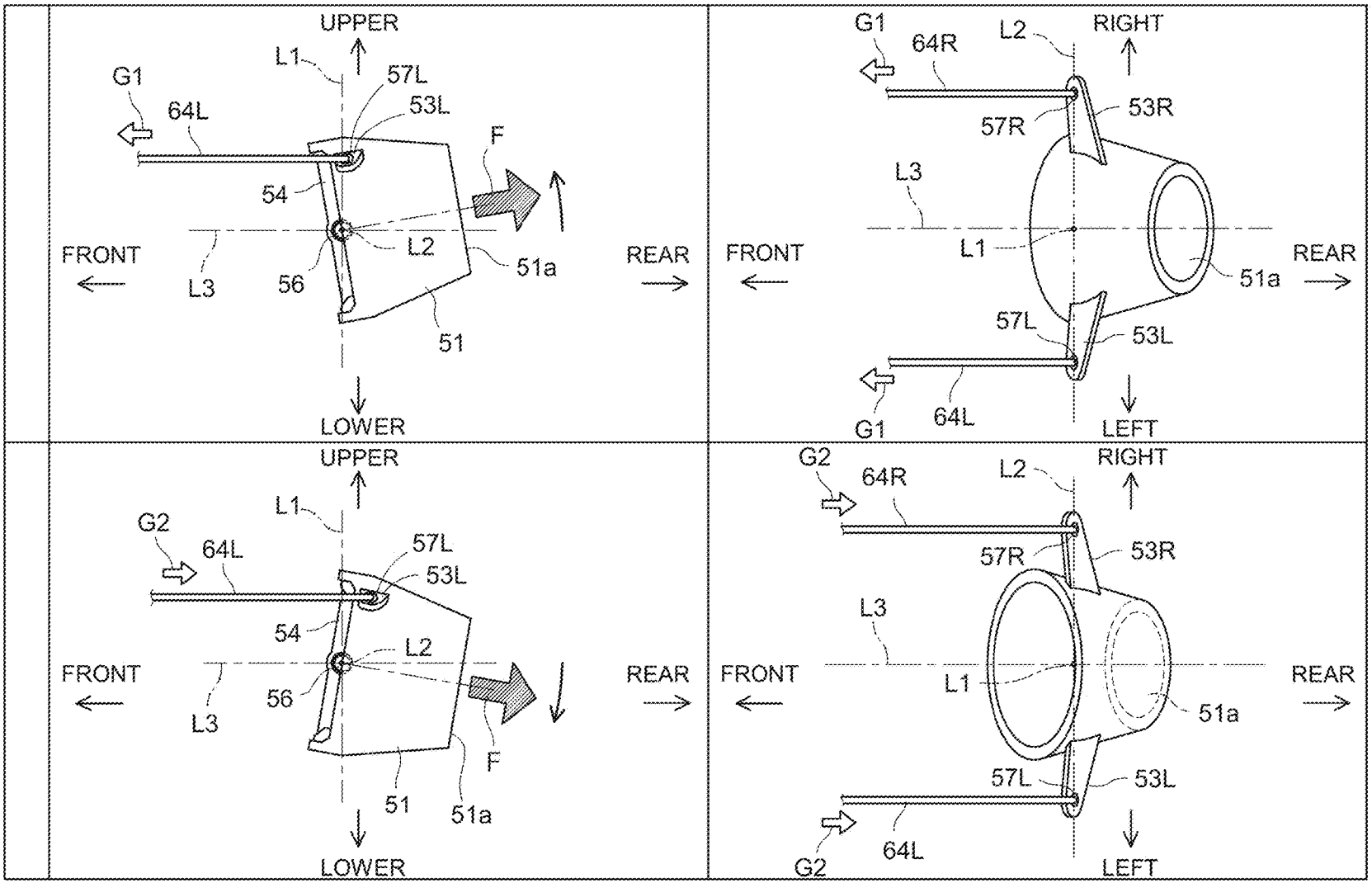
FIGS. 7A and 7B are explanatory views illustrating an operation of the deflector when changing a jet stream direction in an upper-lower direction.
Figure 8A:
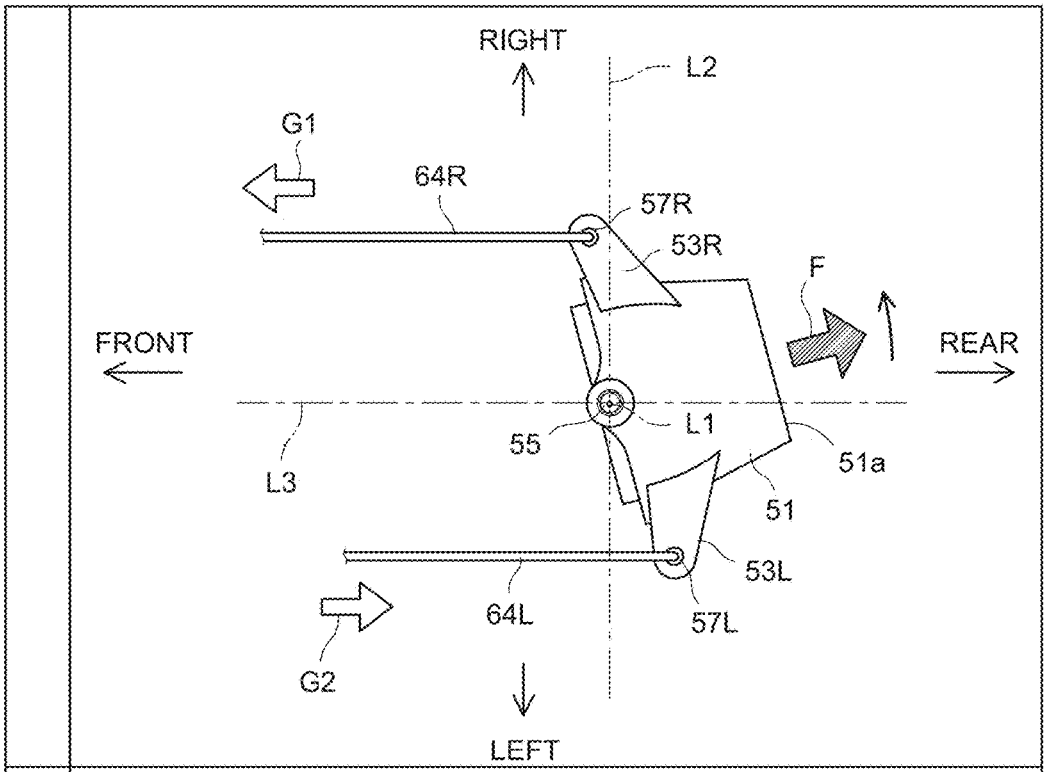
FIGS. 8A and 8B are explanatory views illustrating an operation of the deflector when changing the jet stream direction in the left-right direction.
Figure 8B:
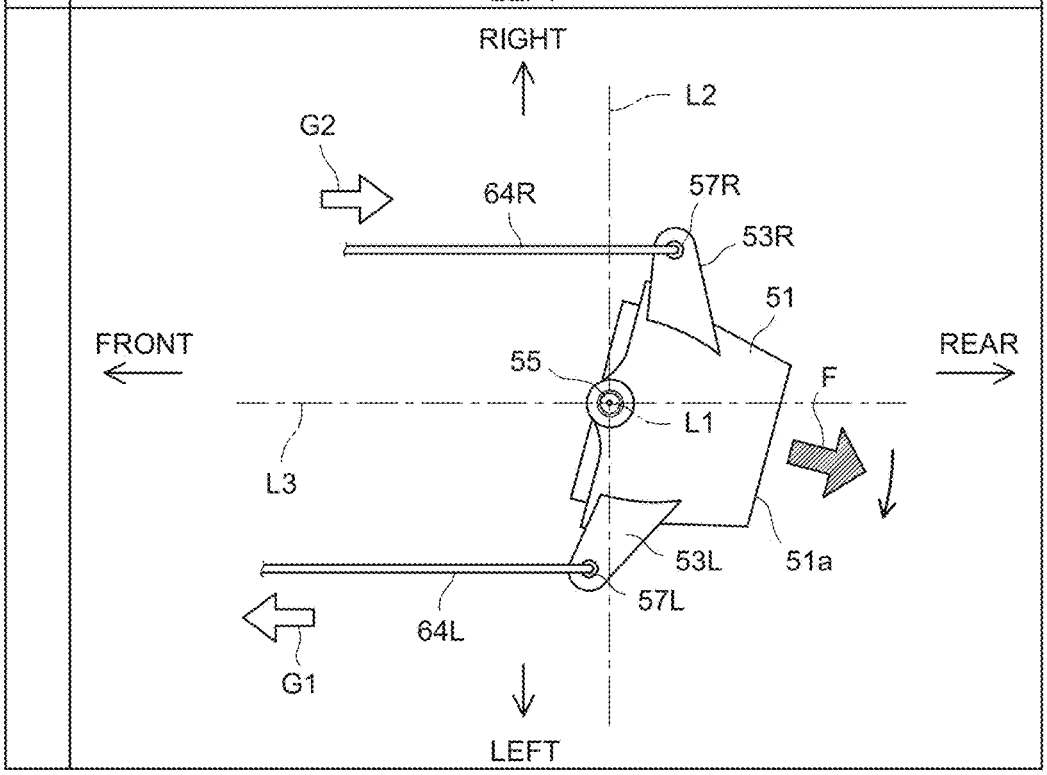

FIGS. 7A and 7B are explanatory views illustrating an operation of the deflector 51 when changing the jet stream direction in the upper-lower direction, and FIGS. 8A and 8B are explanatory views illustrating an operation of the deflector 51 when changing the jet stream direction in the left-right direction.

When a user presses the up switch 75*a* of the third operator 75, the SBW 63 detects the operation of the up switch 75*a*, and the SBW 63 simultaneously and at the same speed moves the trim arm 64R of the right-side trim actuator 62R and the trim arm 64L of the left-side trim actuator 62L in the forward direction (see arrow G1). As a result, as shown in FIG. 7A, the right connecting portion 57R and the left connecting portion 57L of the deflector 51 are shifted forward, and accordingly, the rear end of the deflector 51 rises and the jet stream direction F is changed upward.

On the other hand, when a user presses the down switch 75*b* of the third operator 75, the SBW 63 detects the operation of the down switch 75*b*, and the SBW 63 simultaneously and at the same speed moves the trim arm 64R of the right-side trim actuator 62R and the trim arm 64L of the left-side trim actuator 62L in the rearward direction (see arrow G2). As a result, as shown in FIG. 7B, the right connecting portion 57R and the left connecting portion 57L of the deflector 51 are shifted rearward, and accordingly, the rear end of the deflector 51 is lowered and the jet stream direction F is changed downward.

When a user turns the steering handle 71 to the left, the SBW 63 detects the operation of the steering handle 71, and the SBW 63 causes the right-side trim actuator 62R to move the trim arm 64R forward (see arrow G1) and the left-side trim actuator 62L to move the trim arm 64L rearward (see arrow G2) at the same time and at the same speed. As a result, as shown in FIG. 8A, the right connecting portion 57R of the deflector 51 is shifted forward and the left connecting portion 57L is shifted rearward, and accordingly, the rear end of the deflector 51 is shifted to the right and the jet stream direction F is changed to the right direction. This causes the hull 20 to turn to the left.

When a user turns the steering handle 71 to the right, the SBW 63 detects the operation of the steering handle 71, and the SBW 63 causes the right-side trim actuator 62R to move the trim arm 64R rearward (see arrow G2) and the left-side trim actuator 62L to move the trim arm 64L forward (see arrow G1) simultaneously and at the same speed. As a result, as shown in FIG. 8B, the right connecting portion 57R of the deflector 51 is shifted rearward and the left connecting portion 57L is shifted forward, and accordingly, the rear end of the deflector 51 is shifted to the left and the jet stream direction F is changed to the left direction. This causes the hull 20 to turn to the right.

The techniques disclosed herein are not limited to the preferred embodiments described above and may be modified in various ways without departing from the spirit of the present invention, including the following modifications.

The configuration of the water jet propulsion boat 10 of the above preferred embodiments is only an example and may variously modified. For example, in the above preferred embodiments, the engine 31 is exemplified as the driving source of the driving device 30, but it is not limited to this, e.g., an electric motor or the like may be used. In the above preferred embodiments, the deflector 51 is exemplified as the direction changing member, but the present invention may be applied to, e.g., the reverse bucket 52.

In the above preferred embodiments, the right-side trim actuator 62R and the left-side trim actuator 62L powered by a servomotor are exemplified, but the first and second actuators may be electric actuators utilizing other driving sources (e.g., solenoids and electric motors). In addition, the first and second actuators may be actuators utilizing other driving sources (e.g., magnetic fluid actuators, electrorheological fluid actuators, and hydraulic actuators).

In the above preferred embodiments, the SWB by wireless communication is exemplified as the transmission mechanism to transmit the operation by the steering device 70 to, e.g., the right-side trim actuator 62R, but it is not limited to this, and the SWB by wired communication may be used. In addition, the transmission mechanism may be configured such that the steering handle 71 and the right-side trim actuator 62R or the like are mechanically connected by an operating cable, and the deflector 51 is shifted by the amount of movement corresponding to the amount of movement of the steering handle 71.

In the above preferred embodiments, the deflector 51 is pivotable about the first pivot axis L1 extending along the upper-lower direction and the second pivot axis L2 extending along the left-right direction, but the deflector 51 may be pivoted about two pivoting axes perpendicular to each other and about pivoting axes along each of the two directions different from the upper-lower and left-right directions.

In the above preferred embodiments, the positional relationship between the right connecting portion 57R and the left connecting portion 57L is symmetrical with respect to the first pivot axis L1 when viewed in the upper-lower direction, but the positional relationship may be asymmetrical with respect to the first pivot axis L1.

In the above preferred embodiments, both the right connecting portion 57R and the left connecting portion 57L are located on the upper side with respect to the second pivot axis L2 when viewed in the left-right direction, but these may be located on the lower side with respect to the second pivot axis L2.

In the above preferred embodiments, the alignment direction of the right connecting portion 57R and the left connecting portion 57L is parallel to the second pivot axis L2, but the alignment direction may be non-parallel to the second pivot axis L2.

In the above preferred embodiments, the right connecting portion 57R and the left connecting portion 57L are exemplified as the first and second portions, but the first and second portions are not limited to these and may be, e.g., an upper connecting portion and a lower connecting portion. In other words, the second pivot axis L2 may be located between the upper and lower coupling portions when viewed in the left-right direction, and both the upper and lower coupling portions may be located on one side of the first pivot axis L1 with respect to the left-right direction when viewed in the upper-lower direction.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A water jet propulsion boat comprising:

a hull;

a jet generator on the hull to eject a jet of water;

a direction changer to change a jet stream direction of the jet of water generated by the jet generator;

a steering device on the hull; and a shift mechanism to shift the direction changer according to an operation by the steering device; wherein the direction changer is pivotable with respect to the hull about a first pivot axis extending along a first direction and about a second pivot axis extending along a second direction perpendicular to the first direction;

the shift mechanism includes a first actuator to shift a first portion of the direction changer in a third direction perpendicular to both the first direction and the second direction, and a second actuator to shift a second portion of the direction changer in the third direction; and the first pivot axis is located between the first portion and the second portion when viewed in the first direction, and both the first portion and second portion are located on one side of the second pivot axis with respect to the first direction when viewed in the second direction.

2. The water jet propulsion boat according to claim 1, wherein the first actuator and the second actuator cause the direction changer to change the jet stream direction in the first direction by shifting the first portion and the second portion of the direction changer in a same direction with each other in the third direction; and the first actuator and the second actuator cause the direction changer to change the jet stream direction in the second direction by shifting the first portion and the second portion in opposite directions to each other in the third direction.

3. The water jet propulsion boat according to claim 1, wherein the first direction is an upper-lower direction of the hull.

4. The water jet propulsion boat according to claim 3, wherein both the first portion and the second portion are located above the second pivot axis.

5. The water jet propulsion boat according to claim 1, wherein the first portion and the second portion are aligned in a direction that is parallel to the second pivot axis.

6. The water jet propulsion boat according to claim 1, wherein a positional relationship between the first portion and the second portion is symmetrical with respect to the first pivot axis when viewed in the first direction.

7. The water jet propulsion boat according to claim 1, wherein the shift mechanism includes a steer-by-wire to transmit an operation by the steering device to the first actuator and the second actuator by electrical control.

8. The water jet propulsion boat according to claim 1, wherein both the first actuator and the second actuator include electric actuators.

9. A direction changing device for a water jet propulsion boat that changes a jet stream direction of a jet of water generated by a jet generator in a hull, the direction changing device comprising:

a direction changer; and a shift mechanism to shift the direction changer according to an operation by a steering device on the hull; wherein the direction changer is pivotable with respect to the hull about a first pivot axis extending along a first direction and about a second pivot axis extending along a second direction perpendicular to the first direction;

the shift mechanism includes a first actuator to shift a first portion of the direction changer in a third direction perpendicular to both the first direction and the second direction, and a second actuator to shift a second portion of the direction changer in the third direction; and the first pivot axis is located between the first portion and the second portion when viewed in the first direction, and both the first portion and second portion are located on one side of the second pivot axis with respect to the first direction when viewed in the second direction.

10. The direction changing device according to claim 9, wherein the first actuator and the second actuator cause the direction changer to change the jet stream direction in the first direction by shifting the first portion and the second portion of the direction changer in a same direction with each other in the third direction; and the first actuator and the second actuator cause the direction changer to change the jet stream direction in the second direction by shifting the first portion and the second portion in opposite directions to each other in the third direction.

11. The direction changing device according to claim 9, wherein the first direction is an upper-lower direction of the hull.

12. The direction changing device according to claim 9, wherein both the first portion and the second portion are located above the second pivot axis.

13. The direction changing device according to claim 9, wherein the first portion and the second portion are aligned in a direction that is parallel to the second pivot axis.

14. The direction changing device according to claim 9, wherein a positional relationship between the first portion and the second portion is symmetrical with respect to the first pivot axis when viewed in the first direction.

15. The direction changing device according to claim 9, wherein the shift mechanism includes a steer-by-wire to transmit an operation by the steering device to the first and second actuators by electrical control.

16. The direction changing device according to claim 9, wherein both the first actuator and the second actuator include electric actuators.

* * * * *